United States Patent [19]

Moroishi et al.

[11] Patent Number: 4,530,720

[45] Date of Patent: Jul. 23, 1985

[54] HIGH TEMPERATURE OXIDATION RESISTANT AUSTENITIC STEEL

[75] Inventors: Taishi Moroishi, Kobe; Hisao Fujikawa, Nishinomiya; Junichiro Murayama, Takarazuka; Yuji Shoji, Ashiya, all of Japan

[73] Assignees: Sumitomo Metal Industries, Ltd., Osaka; Nippon Stainless Steel Co., Ltd., Tokyo, both of Japan

[21] Appl. No.: 553,875

[22] Filed: Nov. 21, 1983

Related U.S. Application Data

[63] Continuation of Ser. No. 313,239, Oct. 21, 1981, abandoned, which is a continuation of Ser. No. 101,865, Jun. 8, 1979, abandoned.

[30] Foreign Application Priority Data

Oct. 12, 1977 [JP] Japan ..... 52-122836

[51] Int. Cl.³ ..... C22C 38/38

[52] U.S. Cl. ..... 75/128 A; 75/128 E; 75/128 W; 75/128 T; 75/128 G; 75/128 Z; 75/124; 75/125

[56] References Cited

U.S. PATENT DOCUMENTS

| | | | |
|---|---|---|---|
| 3,716,354 | 2/1973 | Reen et al. | 75/123 R |
| 3,837,846 | 9/1977 | Becker et al. | 75/128 E |
| 3,989,514 | 11/1976 | Fujioka et al. | 75/128 G |
| 4,007,038 | 2/1977 | Deverell | 75/128 W |
| 4,102,677 | 7/1978 | Deverell | 75/128 W |
| 4,108,641 | 8/1978 | Fujioka et al. | 75/128 Z |
| 4,141,762 | 12/1979 | Yamaguchi et al. | 75/122 |

FOREIGN PATENT DOCUMENTS

| | | | |
|---|---|---|---|
| 2331100 | 1/1975 | Fed. Rep. of Germany . | |
| 2458213 | 7/1975 | Fed. Rep. of Germany | 75/128 C |
| 2228119 | 11/1974 | France . | |
| 46-39581 | 11/1971 | Japan | 75/128 C |
| 51-75614 | 6/1976 | Japan . | |
| 52-7317 | 1/1977 | Japan . | |
| 52-7318 | 1/1977 | Japan . | |
| 52-13441 | 2/1977 | Japan . | |
| 52-119411 | 10/1977 | Japan . | |
| 52-138420 | 11/1977 | Japan . | |
| 52-138421 | 11/1977 | Japan . | |
| 52-143912 | 11/1977 | Japan . | |
| 52-143913 | 11/1977 | Japan . | |
| 53-33916 | 3/1978 | Japan . | |
| 1056561 | 1/1967 | United Kingdom . | |
| 1554293 | 1/1979 | United Kingdom . | |

OTHER PUBLICATIONS

Neue Hutte, vol. 16, No. 2, pp. 72–77.

Stahl und Eisen, vol. 96, No. 20, (1976), pp. 960–964; vol. 87, No. 1, (1967), pp. 28–34 and vol. 96, No. 1, (1976), pp. 21–27.

Hutte, "Taschenbuch Fur Eisenhuttenleute", by Peter Spiekermann, pp. 1242–1243 and 1254, 1961.

Handbuch der Sonderstahlkunde, by Eduard Houdremont, pp. 827–828, 1956.

*Primary Examiner*—L. Dewayne Rutledge

*Assistant Examiner*—Debbie Yee

*Attorney, Agent, or Firm*—Parkhurst & Oliff

[57] ABSTRACT

The present invention relates to the austenitic steel having improved resistance to oxidation at the high temperature, comprising not more than 0.10% C, 0.1–5.0% Si, not more than 3% Mn, 7–45% Ni, 15–30% Cr and sulfur content being restricted to not more than 0.003%. According to the present invention, by limiting the sulfur content in the austenitic steel to not more than 0.003%, preferably to not more than 0.0015%, the heat-resisting steel material which can show improved resistance to oxidation under severe conditions including repeated heating to high temperatures and cooling to room temperature is provided.

24 Claims, 1 Drawing Figure

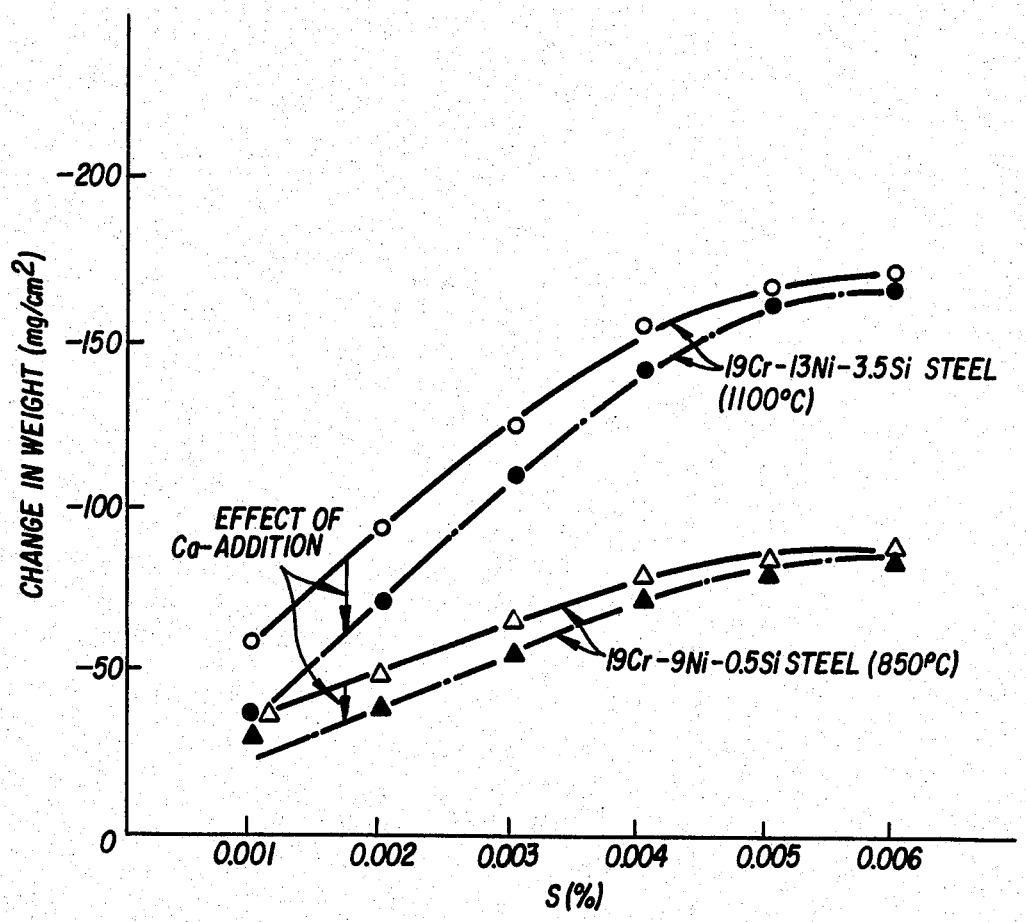
-200
-150
-100
-50
0
CHANGE IN WEIGHT (mg/cm²)
EFFECT OF
Ca-ADDITION
19Cr-13Ni-3.5Si STEEL
(1100°C)
19Cr-9Ni-0.5Si STEEL (850°C)
0.001
0.002
0.003
0.004
0.005
0.006
S (%)

HIGH TEMPERATURE OXIDATION RESISTANT AUSTENITIC STEEL

This is a continuation of application Ser. No. 313,239 filed Oct. 21, 1981, now abandoned, which in turn is a continuation of Ser. No. 101,865, filed June 8, 1979, now abandoned.

TECHNICAL FIELD OF THE INVENTION

The present invention relates to an austenitic steel having improved resistance to oxidation at high temperatures.

BACKGROUND OF THE INVENTION

Recently, requirements for heat-resisting materials used as structural members or components of a high temperature apparatus, such as a heating furnace, heat-exchanger, burner of heating equipment, automobile exhaust converter etc., have become more severe. As structural members or components of such apparatus, the heat-resisting materials are required to have various properties including oxidation resistance, good cold-workability, weldability and high mechanical strength at ambient temperature and even at high temperatures. Oxidation resistance in this context means not only less oxidation during usage at high temperatures but also the absence of peeling off of scales even after being subjected to cyclic treatment of heating to high temperature and then cooling to ambient temperature. Good cold workability is also required to work the material into an article having a complicated shape.

Since the structural members or components mentioned above are usually to be mass-produced, the cost of the material should be as low as possible and cost is an important factor in the development of a new high temperature material.

It is usually possible to improve one particular property of a metallic material by adding thereto a large amount of a particular element. Taking a heat-resisting steel for instance, the addition of a large amount of Cr, Si or Al may be expected to give a significant improvement in its heat resitance. However, as is known in the art, if a large amount of Cr, Si or Al is added, properties other than heat resistance are inevitably sacrificed and the result is a significant impairment of workability or weldability.

On the other hand, if we disregard cost, there are Ni-based alloys, for example, which are excellent not only in high temperature-oxidation resistance but also in other properties. However, they are so expensive that they are not suitable for use as materials for mass produced articles.

With all the above factors and conditions in mind, it is thought that the most practical and advantageous way to get a desirable heat-resistant material is to improve a specific desired property of a widely used and relatively less expensive conventional material without impairing its inherent characteristics.

DISCLOSURE OF THE INVENTION

The present invention was completed having in mind the aim of markedly improving the resistance to oxidation of an austentic steel, which is one of the most widely used heat-resisting materials.

The term "austenitic steel" herein used means alloy steels containing Ni and Cr as major alloying elements and maintaining a stable austentitic structure at ambient temperature. Various kinds of austenitic steel incorporating different combinations of Ni within the range of 7–45% and Cr within the range of 15–30% are known.

For example, the 18Cr-10Ni series represented by SUS 304, the 25Cr-20Ni series represented by SUS 310S, the 20Cr-32Ni series known as Incoloy 800 and modifications thereof containing Mo, Si, Ti, Nb, etc. are commercially available. The appropriate one is selected and used according to the intended use.

In a broad way, since there is not a great difference in the mechanical strength and formability of these austenitic steels, selection depends mostly on the considerations of service temperature and economy. That is, for relatively low temperature applications steels containing Cr and Ni in small amounts are employed and for relatively high temperature applications steels containing Cr, Ni and other alloying elements, which are relatively expensive, in large amounts are employed.

Thus, it will be very significant from the viewpoint of economy and efficient use of material resources to raise possible service temperature by further improving a steel having the same basic composition. This way of developing steels is particularly practical in the light of the strong public demand for efficient use of material resources.

The present invention is based on findings obtained as results of study and experiments on austenitic steels to be used as a heat-resisting material. It was found that sulfur in austenitic steels has an important influence on their oxidation resistance and that a remarkable improvement in heat-resistance of austenitic steel can be achieved by reducing the sulfur content to 0.003% or less.

In general, because sulfur adversely affects the hot-working, the sulfur content of austenitic steel has been restricted to not more than 0.03% in both the corrosion-resisting steels and heat-resisting steels.

Austenitic steels on the market usually contain around 0.010% sulfur, but such a low sulfur content is not thought to have any particular effect on their mechanical or chemical properties.

However, the inventors of the present invention investigated the effect of sulfur on the resistance to oxidation of steels which contain sulfur in an amount far below the usual content of sulfur which is included as an impurity. The inventors confirmed that sulfur has to a great extent an adverse effect on the oxidation of austenitic steels and unexpectedly found that the oxidation resistance of the austenitic steel can be remarkably improved when the sulfur content is restricted to an extremely small amount, i.e. not more than 0.003%.

The attached graphs illustrate the results of experiments carried out in a manner to be described hereinafter with respect to (A) 19Cr-13Ni-3.5Si-type austenitic steel and (B) 19Cr-9Ni-0.5Si-type austenitic steel, respectively with or without the addition of Ca.

Steels designated as (A) were held at 1100° C. and those designated (B) at 850° C. They were subjected to 400 cycles of heating at the above mentioned temperature for 30 minutes followed by 30 minutes cooling. The relation between the weight loss after experiment and the sulfur content was plotted in the graphs.

It is clear from the drawing that for both steels, (A) and (B), the weight loss due to oxidation decreases with the decrease in the sulfur content. Steel (A) containing 3.5% Si showed a markedly high decreased in weight loss, particularly, when the sulfur content was below 0.003%, the weight loss due to oxidation rapidly decreased. It may be said that the steels with Ca added (indicated by and ) show greater resistance to oxidation than the steels having the same composition but without Ca (indicated by and Δ), and that the improvement is more significant when the sulfur content is smaller.

Since this oxidizing test was carried out under relatively severe conditions by repeating the heating and cooling cycle, such a remarkable reduction in weight loss, which was obtained by reducing the sulfur content to less than 0.003%, is particularly significant in view of the utility of heat-resisting steels.

The reason why restricting the sulfur content to such a low level can achieve such an improvement in heat-resistance is though to be as follows.

Sulfur which is usually contained in a steel in an amount of around 0.01% combines with the Mn contained therein to form MnS. However, the thus formed MnS tends to decompose during the application of the steel at an elevated temperature and the liberated sulfur concentrates along the grain boundary of the austenitic structure. The heat resistance of a steel which contains Cr, or additionally Si, Al, etc. is due to the protective film of stable oxides formed by the oxidation of these elements. However, as the liberated sulfur concentrates along the grain boundary of the steel as mentioned above, the movement of Cr, Si, etc. to the surface region of the steel through diffusion, which is especially active through the grain boundary, is prohibited so that the formation of the protective oxide film and recovery thereof, if the protective film is once formed, cannot be achieved so rapidly.

In addition, since the liberated sulfur which has been concentrated along the grain boundary easily combines with oxygen, it acts as a starting site of oxidation and causes the grain boundary to be brittle and the peeling off of oxide scales to be accelerated.

The complete removal of sulfur would eliminate these undesirable effects of sulfur, but it is impossible to completely eliminate sulfur from a steel composition. However, as described hereinbefore, it was found that it is not necessary to reduce the sulfur content to zero, and that it is possible to eliminate these undesirable effects due to the presence of sulfur by reducing the sulfur content to not more than 0.003%.

That is, when the total amount of sulfur in a steel is reduced to at or below this limit, the amount of liberated sulfur, if any, is very small. Further, sulfur in an extremely small amount, i.e. not more than 0.003%, easily and completely combines with any Ca, Mg, etc. introduced into the steel from a refractory material of a furnace structure or a slag during the preparation of the melt to form a stable sulfide or oxysulfide of Ca, Mg, which is stable at a high temperature. These compounds do not decompose at high service temperatures to provide free sulfur. Thus, the upper limit of sulfur which may form sulfide or oxysulfide stable at a high temperature is 0.003%. If the sulfur content is more than 0.003%, MnS is formed bringing about such disadvantages as mentioned above.

In view of these facts, it is also noted that when the sulfur content is below 0.003%, but near to 0.003%, it is more advantageous to add intentionally Ca, Mg, rare earths or Y which can show an equivalent effect, in order to accelerate the formation of these stable compounds of sulfur.

On the other hand, when these additives are not added intentionally or a supply of these elements cannot be expected from a slag and so on because of specific conditions for preparing the melt, it will be advisable to limit the sulfur content to not more than 0.0015%.

The present invention of an austenitic steel having improved resistance to high temperature oxidation, which has been completed on the basis of the findings mentioned above, is characterized by the following composition:

C: not more than 0.1%
Si: 0.1–5.0%
Mn: not more than 3%
Ni: 7–45%
Cr: 15–30%
S: not more than 0.003%.

The austenitic steel of the present invention includes all kinds of austenitic steels to be used within the temperature range of from 700°–800° C. to 1200° C., and it may also contain, in addition to the essential elements mentioned above, other alloying elements such as are contained in the usual austenitic steels. The variety and amount of these additional alloying elements to be added are determined by considering not only the balance with Ni, Cr and Si in the respective amounts above but also by the conditions required for the steel, including service temperature, workability, weldability, mechanical properties, etc. However, whatever combination of these essential alloying elements and additional alloying elements is selected, the steel of the present invention, the sulfur content of which is restricted to not more than 0.003%, is superior in its resistance to the oxidation to those conventional steels which have the same composition with sulfur in a usual amount. Further, with respect to its other essential properties, the alloy of the present invention is as good as or better than the conventional steels.

The reasons for selecting the essential alloying elements and limiting the amounts thereof as in the above will be described hereinafter in conjunction with the preferred embodiments of the present invention.

Carbon (C) tends to form carbide of mainly the $Cr_{23}C_6$ type when the steel is used at a high temperature and in the weld zone when it is welded, and this offsets the effect of the improvement in the oxidation resistance due to the addition of chromium and impairs the adhesion of scales. Also, too much carbon adversely affects the weldability and workability of the steel, so that the upper limit of carbon is restricted to 0.10%, a limit which is also recommended for the purpose of preventing the precipitation of -phase. From the viewpoint of improving the oxidation resistance, it is desirable to restrict the carbon content to as far below said upper limit as possible. However, if the mechanical strength is particularly desired, carbon may be added in an amount close to said upper limit. In addition, in order to reduce the undesired effects due to carbon, it is preferable to add Ti, Nb, Zr and Ta which preferentially combine with carbon to reduce such undesirable effects. These additives are equivalent in their effect and one or more of them may be employed. The total amount of these elements is to be limited to at least 4 times the carbon content (C%). However, since the addition of these elements in excess results in precipitation of an intermetallic compound, impairing the purity and workability of the steel, the upper limit for such additives is 1.5%.

Silicon (Si) is added as a deoxidizing agent and for that purpose an amount of not less than 0.1% is required.

Silicon also remarkably improves the oxidation resistance of a steel. For example, austenitic steels containing 2–5% Si, such as AISI 302 B and JIS XM 15J1, are known in the art.

According to the results of experiments done by the inventors, the improvement in oxidation resistance due to the restriction of the sulfur content to not more than 0.003% was especially great in case of a steel containing more than 1% Si, particularly more than 3.0% Si (see the drawing attached). However, a silicon content of more than 5% would markedly degrade the workability and weldability of the steel. Thus, a silicon content of not more than 5% is recommended.

Manganese (Mn) is added as a deoxidizing agent and is also effective for stabilizing the austenitic structure of the steel. However, manganese is not helpful for improving the resistance to oxidation, so the manganese content should be limited to not more than 3%. Manganese in an amount of more than 3% has an adverse effect on the hot-workability of a steel and also causes corrosion of the furnace refractory material during the preparation of a melt.

Nickel (Ni) and chromium (Cr) are essential elements for providing the fundamental properties of austenitic steels. If the nickel content is less than 7% and the chromium content is less than 15%, it is impossible to maintain the austenitic structure to provide required properties at the minimum level. On the other hand, if the nickel content is more than 45%, then the resulting alloy becomes similar to a nickel based alloy, which is difficult to put to practical use in view of its high cost. Though the resistance to oxidation improves with increase in the chromium content, it is very difficult to maintain the austenitic structure when more than 30% chromium is added and also the workability is markedly degraded.

Thus, the nickel content and the chromium content are restricted to within the ranges of 7–45% Ni and 15–30% Cr, respectively. The respective amounts of Ni and Cr are adjusted within these ranges so as to maintain the austenitic structure and give the desired mechanical and chemical properties.

Accordingly, a great number of combinations of Ni and Cr contents is possible. From a practical viewpoint, it is desirable to select the Ni and Cr contents in conformity with the steels known in the art and available on the market. This is because, if based on the widely employed steels, the general properties of the resulting steels in accordance with the present invention will be easily determined and there will be a little or no trouble when these steels are put to practical use. In this point, however, as described hereinbefore and further detailed hereinafter, it is to be noted that, though the present invention employs the same amounts of Ni and Cr as in the conventional steels, the resulting oxidation resistance is markedly superior to that of the conventional steels, i.e. the present invention steel can endure a higher temperature than the conventional steel having the same amounts of Ni and Cr. In other words, according to the present invention, a less expensive steel, namely one containing less Ni and Cr may advantageously be employed under the same conditions. Examples of Ni and Cr combinations include, typically: 7–15% of Ni and 15–20% of Cr; 10–15% of Ni and 15–20% of Cr or 20–25% of Cr; 15–25% of Ni and 20–30% of Cr; and 30–35% of Ni and 20–25% of Cr.

The alloying elements mentioned above are essential constituents of the present invention steel, and the present invention steel may also contain a wide variety of additional elements in view of its purpose of application and its necessity in the preparation of a melt. Typical additional elements and quantities thereof will be discussed in detail in the following.

Aluminum (Al) is, in most cases, required as a deoxidizing agent. Particularly, Al is required in case Ca, Mg, etc. are intentionally added, as described hereinafter, or in case it is required to thoroughly utilize the slag effect, since the oxygen content of a melt should previously be reduced thoroughly, and a small amount of aluminum is added for this purpose. However, it is to be noted that when the residual Al exceeds 0.1%, it sometimes brings about difficulties in the casting step following the preparation of the melt.

The addition of copper (Cu) even in a small amount is effective for improving the adhesion of scales which form on the surface of the steel due to the oxidation thereof. However, when the copper content exceeds 1.5%, then the resistance to oxidation is impaired.

Molybdenum (Mo), whichis effective for improving the strength of the steel at high temperatures, may be added to the melt, when the steel is intended to be used at a high temperature under a heavy load. However, more than 3% molybdenum would adversely affect the oxidation resistance and increase the cost of the resulting steel. The addition of molybdenum is restricted to not more than 3%.

The purpose of the addition of Ti, Nb, Zr and Ta has been described in conjunction with that of carbon.

With respect to Ca, Mg, rare earths and Y, these elements combine with sulfur to form a stable sulfide or oxysulfide which does not decompose at high temperatures, thus improving the resistance to oxidation. However, such an improvement is possible only when the sulfur content is restricted to not more than 0.003%. Namely, the addition of these elements in a relatively large amount to the conventional steel containing a usual amount of sulfur may form an excessive amount of the compound with sulfur, which degrades not only the resistance to oxidation, but also mechanical properties of the steel.

If the sulfur content is limited to not more than 0.003%, particularly to not more than 0.0015%, the oxidation resistance will be improved even in the case of a steel which does not contain Ca, Mg, rare earths and Y substantially. In addition, a small amount of Ca, Mg, etc. is expected to be introduced from the refractory material of the furnace or from the slag during preparation of the melt, and they combine with sulfur to eliminate the adverse effect of sulfur. However, when it is desired to provide further improved resistance to oxidation, it is necessary to intentionally add at least one of Ca, Mg, rare earths and Y in the total amount of not more than 0.10%.

It is to be noted that the steel of the present invention may also contain an element other than these essential components and secondary components already mentioned in the above as incidental impurities. Of these incidental impurities, as already mentioned, sulfur is of the most importance. The sulfur content should be restricted to not more than 0.003%. If the sulfur content of the steel composition is more than the upper limit, the intended improvement in oxidation resistance cannot be established. Of course, it is desirable to make the sulfur content as low as possible, preferably less than 0.0015%.

Reduction of the sulfur content to such an extent is possible on an industrial scale by preparing the melt by means of an Argon-Oxygen decarburization process, which has recently been practiced in steel making.

With respect to impurities other than sulfur, it is sufficient to restrict the phosphorus content to not more than 0.040% as in the conventional austenitic steel, and nitrogen and oxygen are desirably restricted to as low a content as possible, practically to not more than 0.03% and 0.02%, respectively.

BRIEF DESCRIPTION OF THE DRAWING

The attached drawing is a graph obtained by plotting the variation in weight in a repeated oxidizing test at high temperatures with respect to the sulfur content.

BEST MODE OF THE INVENTION

The best mode of the invention in view of the practical viewpoint will be described in conjunction with the preferred embodiments of the present invention.

In this respect, it is to be noted that the oxidation resistance test mentioned hereinafter was carried out under the following conditions.

Test piece: Plate of 25 mm long×20 mm wide×1.5 mm thick

Testing: The specimens were held in the furnace heated at the indicated temperature for 30 minutes and then they were set in the air for 30 minutes. This heating and cooling cycle was repeated 400 times. The resistance to oxidation was estimated in terms of the difference in weight of the specimens between pre- and post-examination.

Table 1 shows the results of the test mentioned above on the specimens of the typical austenitic steels on the market, which are shown only for the purpose of comparison with the steel of the present invention to be described hereinafter.

TABLE 1

Oxidation Resistance of Austenitic Steels on the Market.

| steel | chemical composition (% by weight) C | Si | Mn | P | S | Ni | Cr | others | heating temp. (°C.) | test results change in weight ($mg/cm^2$) |
|---|---|---|---|---|---|---|---|---|---|---|
| SUS 304 | 0.06 | 0.75 | 1.73 | 0.021 | 0.005 | 8.79 | 19.06 | | 850 | −90.56 |
| SUS 316 | 0.06 | 0.56 | 1.54 | 0.023 | 0.007 | 13.05 | 16.72 | $Mo_{2.21}$ | " | −82.45 |
| SUS 321 | 0.06 | 0.55 | 1.56 | 0.023 | 0.006 | 11.95 | 17.87 | $Ti_{0.41}$ | " | −83.07 |
| SUS 347 | 0.06 | 0.58 | 1.62 | 0.022 | 0.006 | 11.90 | 17.93 | $Nb_{0.67}$ | " | −82.86 |
| AISI 302B | 0.08 | 2.34 | 0.95 | 0.015 | 0.008 | 9.12 | 18.57 | | 1000 | −97.21 |
| XM 15J1 | 0.034 | 3.10 | 0.47 | 0.023 | 0.006 | 13.00 | 18.82 | | 1100 | −165.92 |
| SUS 309S | 0.06 | 0.53 | 0.89 | 0.029 | 0.009 | 12.45 | 22.63 | | 1050 | −96.55 |
| Incoloy 800 | 0.07 | 0.51 | 1.32 | 0.023 | 0.006 | 32.05 | 20.53 | | 1000 | −81.17 |
| SUS 310S | 0.06 | 1.10 | 1.65 | 0.028 | 0.010 | 20.08 | 25.65 | | 1100 | −80.66 |

EXAMPLE 1

In this example, the resistance to high temperature oxidation of the austenitic steels having the following composition was determined:

C: not more than 0.10%, Si: 0.1–1.0%,
Mn: not more than 3.0%, Ni: 7–15%,
Cr: 15–20%, at least one of Al, Cu, Mo, Ti, Nb, Zr, Ta, Ca, Mg, rare earths and Y, if necessary, and S: not more than 0.003%.

This type of steel corresponds to austenitic steels commercially available as SUS 304, 316, 321, 347, etc., which are classified as relatively less expensive steels having a small amount of Ni and Cr.

Table 2 shows the results of the oxidizing test. The heating temperature was 850° C. It also shows the chemical compositions of the present invention steels as well as the reference steels having the same composition except for the higher content of sulfur. When the test results of the present invention steels 1–8 corresponding to SUS 304 except for the lower sulfur content are compared with those of the reference steels 9–10 in Table 2, the weight loss of the present invention steels is seen to be approximately half that of the latter steels. It is also noted that even the reference steels 9–10 show a slight improvement in the resistance to oxidation compared to the commercially available steels, such as SUS 304 indicated in Table 1. It might be suggested that this is because of the effect of the addition of Ca, Y, etc. However, since the difference in the oxidation resistance between the present invention steels and the reference steels is extremely great, it is concluded that such a difference is due to the difference in their sulfur contents.

Furthermore, when the present invention steels 11–18 corresponding to SUS 316 except for the lower sulfur content are compared with the reference steels 19–20, it is noted that all of the present invention steels and the reference steels show some improvement in resistance to oxidation and are relatively superior to SUS 304, and particularly the present invention steel shows substantial improvement over the conventional steels.

In addition, in examining the steels 21–32 which contain at least one of Ti, Nb, Zr and Ta, it is noted that the present invention steels 21–28 show a relatively high degree of improvement in resistance to oxidation compared to those which do not contain these elements, though the reference steels do not show so much improvement.

In conclusion, it can be said that the improvement in oxidation resistance due to the lower sulfur content is remarkable even in the steel which contains Ti, Nb, etc.

TABLE 2

| steel | chemical composition (% by weight) C | Si | Mn | P | S | Ni | Cr | Mo | Al | Ti | Nb | Zr | Ta | Ca | Mg | R.E | Y | heating temp. (°C.) | test results change in weight (mg/cm²) |
|---|---|---|---|---|---|---|---|---|---|---|---|---|---|---|---|---|---|---|---|
| present invention 1 | 0.05 | 0.60 | 1.63 | 0.0027 | 0.001 | 9.45 | 18.85 | | 0.002 | | | | | | | | | 850 | −46.62 |
| present invention 2 | 0.08 | 0.56 | 1.67 | 0.026 | 0.001 | 9.25 | 18.65 | | 0.015 | | | | | 0.0010 | | | | " | −40.15 |
| present invention 3 | 0.04 | 0.37 | 1.67 | 0.027 | 0.001 | 9.45 | 18.40 | | 0.008 | | | | | | 0.0026 | | | " | −43.08 |
| present invention 4 | 0.012 | 0.54 | 1.47 | 0.028 | 0.002 | 9.50 | 17.75 | | 0.005 | | | | | 0.0008 | | 0.0009 | | " | −39.86 |
| present invention 5 | 0.021 | 0.43 | 1.56 | 0.027 | 0.002 | 9.45 | 17.50 | | 0.005 | | | | | 0.0036 | | | 0.0015 | " | −35.64 |
| present invention 6 | 0.005 | 0.52 | 1.86 | 0.015 | 0.002 | 10.21 | 17.86 | | 0.009 | | | | | 0.0052 | 0.0009 | | | " | −43.29 |
| present invention 7 | 0.06 | 0.78 | 1.36 | 0.012 | 0.001 | 8.56 | 17.79 | | 0.012 | | | | | 0.0016 | 0.0018 | 0.0005 | | " | −38.64 |
| present invention 8 | 0.001 | 0.46 | 1.32 | 0.020 | 0.001 | 9.74 | 18.86 | | 0.042 | | | | | 0.0071 | | | | " | −48.54 |
| reference 9 | 0.06 | 0.55 | 1.66 | 0.023 | 0.006 | 9.30 | 18.95 | | 0.021 | | | | | 0.0053 | | | | " | −86.53 |
| reference 10 | 0.048 | 0.58 | 1.63 | 0.009 | 0.005 | 9.26 | 18.48 | | 0.009 | | | | | 0.0042 | | | 0.0100 | " | −83.02 |
| present invention 11 | 0.012 | 0.54 | 1.47 | 0.028 | 0.002 | 13.50 | 16.75 | 2.64 | 0.005 | | | | | | | | | " | −32.05 |
| present invention 12 | 0.021 | 0.43 | 1.56 | 0.027 | 0.002 | 13.45 | 16.50 | 2.10 | 0.065 | | | | | | | | | " | −28.13 |
| present invention 13 | 0.025 | 0.47 | 1.50 | 0.027 | 0.001 | 13.80 | 16.70 | 2.17 | 0.005 | | | | | 0.0016 | | | | " | −13.58 |
| present invention 14 | 0.06 | 0.51 | 1.53 | 0.016 | 0.001 | 13.01 | 16.42 | 2.05 | 0.015 | | | | | | 0.025 | | | " | −19.30 |
| present invention 15 | 0.08 | 0.46 | 1.62 | 0.015 | 0.003 | 12.86 | 16.82 | 2.11 | 0.009 | | | | | 0.0008 | | 0.0070 | | " | −28.57 |
| present invention 16 | 0.05 | 0.82 | 1.67 | 0.020 | 0.001 | 12.56 | 16.58 | 2.32 | 0.024 | | | | | 0.0004 | | | 0.0050 | " | −30.25 |
| present invention 17 | 0.041 | 0.77 | 1.36 | 0.008 | 0.002 | 12.97 | 16.66 | 2.38 | 0.002 | | | | | 0.0065 | 0.0038 | | | " | −16.62 |
| present invention 18 | 0.005 | 0.38 | 1.21 | 0.003 | 0.001 | 13.36 | 16.54 | 2.78 | 0.024 | | | | | 0.0032 | 0.0040 | 0.003 | | " | −13.36 |
| reference 19 | 0.07 | 0.62 | 1.48 | 0.018 | 0.008 | 13.05 | 16.82 | 2.32 | 0.015 | | | | | 0.0066 | | | | " | −73.26 |
| reference 20 | 0.038 | 0.48 | 1.65 | 0.025 | 0.010 | 12.98 | 16.48 | 2.76 | 0.025 | | | | | | 0.0048 | | | " | −65.04 |
| present invention 21 | 0.06 | 0.65 | 1.66 | 0.023 | 0.001 | 12.11 | 18.05 | | 0.004 | 0.34 | | | | | | | | " | −26.83 |
| present invention 22 | 0.06 | 0.50 | 1.73 | 0.020 | 0.001 | 11.93 | 17.85 | | 0.058 | 0.50 | | | | | | | | " | −24.21 |
| present invention 23 | 0.021 | 0.57 | 1.41 | 0.022 | 0.002 | 12.07 | 17.25 | | 0.025 | 0.34 | | | | 0.0024 | | | | " | −18.55 |
| present invention 24 | 0.06 | 0.54 | 1.62 | 0.023 | 0.002 | 12.14 | 17.30 | | 0.013 | | 0.73 | | | | 0.0055 | | | " | −20.03 |
| present invention 25 | 0.07 | 0.52 | 1.68 | 0.021 | 0.001 | 11.92 | 17.80 | | 0.009 | | 0.83 | | | 0.009 | | 0.0073 | | " | −20.00 |
| present invention 26 | 0.015 | 0.51 | 1.79 | 0.021 | 0.002 | 12.00 | 17.60 | | 0.016 | | 0.38 | | | 0.0035 | | | 0.0092 | " | −30.01 |
| present invention 27 | 0.08 | 0.60 | 1.62 | 0.026 | 0.002 | 11.71 | 17.90 | 2.16 | 0.005 | | | 0.75 | | 0.0006 | 0.0018 | | | " | −19.73 |
| present invention 28 | 0.05 | 0.57 | 1.72 | 0.021 | 0.001 | 11.89 | 17.90 | 2.35 | 0.023 | | | | 1.05 | 0.0014 | 0.0033 | 0.0008 | | " | −16.66 |
| reference 29 | 0.05 | 0.49 | 1.55 | 0.028 | 0.008 | 11.93 | 18.15 | | 0.006 | 0.48 | | | | | | | | " | −77.37 |
| reference 30 | 0.06 | 0.53 | 1.69 | 0.022 | 0.007 | 12.33 | 18.10 | | 0.044 | | 0.67 | | | | | | | " | −75.41 |
| reference 31 | 0.04 | 0.52 | 1.68 | 0.025 | 0.007 | 11.89 | 17.90 | | 0.015 | | | 0.45 | | 0.0033 | | | | " | −69.86 |
| reference 32 | 0.07 | 0.69 | 1.62 | 0.023 | 0.010 | 11.89 | 18.00 | 2.30 | 0.018 | | | | 1.22 | | | 0.0040 | | " | −79.05 |

EXAMPLE 2

In this example, the resistance to the high temperature oxidation of the steels having the following composition was determined:

C: not more than 0.10%, Si: 1.0–3.0%,
Mn: not more than 3.0%, Ni: 7–15%,
Cr: 15–20%, at least one of Al, Cu, Mo,
Ti, Nb, Zr, Ta, Ca, Mg, rare earths and Y, if necessary,
S: not more than 0.003%.

This type of steel contains a higher content of Si compared with those of Example 1, for the purpose of further improving oxidation resistance. This type of steel corresponds to AISI 302B which is commercially available.

Table 3 shows the results of the test. The heating temperature was 1000° C.

It is noted that the resistance to oxidation of the present invention steels is much better than that of AISI 302B commercially available shown in Table 1.

It is also noted that in those cases where the sulfur content is not reduced the addition of Ca, Mg, rare earths, Ti, Zr, etc. does not result in any improvement in resistance to oxidation.

TABLE 3

| Steel | chemical composition (% by weight) C | Si | Mn | P | S | Ni | Cr | Cu | Al | Ti | Nb | Zr | Ta | Ca | Mg | R.E | Y | heating temp. (°C.) | test results change in weight ($mg/cm^2$) |
|---|---|---|---|---|---|---|---|---|---|---|---|---|---|---|---|---|---|---|---|
| present invention 1 | 0.06 | 2.35 | 0.97 | 0.015 | 0.001 | 9.12 | 18.47 | | 0.003 | | | | | | | | | 1000 | −39.54 |
| present invention 2 | 0.08 | 1.72 | 0.46 | 0.009 | 0.001 | 9.56 | 19.02 | | 0.062 | | | | | | | | | " | −30.00 |
| present invention 3 | 0.04 | 1.56 | 0.52 | 0.018 | 0.002 | 9.72 | 18.94 | | 0.005 | | | | | 0.0023 | | | | " | −35.01 |
| present invention 4 | 0.032 | 2.06 | 0.82 | 0.024 | 0.002 | 9.59 | 18.74 | | 0.015 | | | | | | 0.0030 | | | " | −31.42 |
| present invention 5 | 0.045 | 1.86 | 0.77 | 0.021 | 0.001 | 9.74 | 19.31 | | 0.009 | | | | | 0.0006 | 0.0015 | | | " | −40.05 |
| present invention 6 | 0.021 | 2.11 | 0.87 | 0.025 | 0.002 | 9.36 | 18.52 | | 0.045 | | | | | 0.0008 | | 0.0004 | | " | −30.56 |
| present invention 7 | 0.042 | 2.50 | 1.26 | 0.028 | 0.001 | 9.41 | 18.86 | | 0.001 | | | | | 0.0005 | | | 0.007 | " | −38.05 |
| present invention 8 | 0.06 | 2.74 | 1.15 | 0.014 | 0.003 | 10.04 | 18.92 | | 0.032 | | | | | 0.0055 | 0.0042 | | 0.0009 | " | −29.98 |
| reference 9 | 0.08 | 2.44 | 0.92 | 0.016 | 0.006 | 9.38 | 18.63 | | 0.015 | | | | | | | | | " | −100.56 |
| reference 10 | 0.06 | 2.68 | 0.98 | 0.023 | 0.005 | 9.52 | 18.53 | | 0.018 | | | | | 0.0072 | 0.009 | | | " | −92.06 |
| reference 11 | 0.046 | 1.87 | 0.87 | 0.021 | 0.006 | 9.08 | 18.37 | | 0.009 | | | | | 0.0033 | | 0.0092 | | " | −98.47 |
| reference 12 | 0.053 | 1.64 | 1.08 | 0.013 | 0.006 | 9.82 | 18.41 | | 0.042 | | | | | 0.0062 | | | 0.0093 | " | −95.52 |
| present invention 13 | 0.06 | 1.56 | 0.54 | 0.023 | 0.001 | 10.03 | 19.15 | 0.42 | 0.009 | | | | | | | | | " | −29.52 |
| present invention 14 | 0.042 | 1.78 | 0.63 | 0.015 | 0.001 | 9.53 | 19.08 | 0.56 | 0.071 | | | | | | | | | " | −23.32 |
| present invention 15 | 0.08 | 2.36 | 0.98 | 0.021 | 0.002 | 9.43 | 18.65 | 0.42 | 0.016 | | | | | 0.0063 | | | | " | −19.50 |
| present invention 16 | 0.048 | 2.48 | 0.88 | 0.013 | 0.001 | 9.31 | 18.54 | 0.81 | 0.012 | | | | | | 0.0050 | | | " | −17.64 |
| reference 17 | 0.050 | 2.55 | 0.93 | 0.012 | 0.006 | 9.30 | 18.65 | 0.77 | 0.025 | | | | | 0.0072 | | | | " | −92.38 |
| present invention 18 | 0.045 | 1.65 | 0.53 | 0.015 | 0.001 | 9.84 | 19.08 | | 0.009 | 0.18 | 0.23 | | | 0.0012 | | | | " | −30.01 |
| present invention 19 | 0.002 | 1.77 | 0.81 | 0.002 | 0.001 | 9.51 | 19.00 | | 0.018 | | 0.15 | | 0.08 | 0.0009 | | | 0.0037 | " | −27.29 |
| present inevntion 20 | 0.07 | 2.45 | 0.95 | 0.026 | 0.002 | 9.66 | 18.62 | | 0.029 | 0.20 | | 0.21 | | 0.0024 | 0.0031 | | | " | −23.33 |
| present invention 21 | 0.024 | 2.51 | 0.93 | 0.018 | 0.001 | 9.43 | 18.45 | | 0.045 | | 0.13 | | 0.06 | 0.0005 | 0.0004 | 0.0009 | | " | −20.24 |
| reference 22 | 0.031 | 2.52 | 0.98 | 0.015 | 0.006 | 9.51 | 18.30 | | 0.040 | 0.36 | | | | 0.0037 | | | | " | −84.75 |

EXAMPLE 3

In this example, the resistance to high temperature oxidation of the steels having the following composition was determined:

C0: not more than 0.10%, Si: 3.0–5.0%,

Mn: not more than 3%, Ni: 10–15%,

Cr: 15–20%, at least one of Al, Cu, Mo,

Ti, Nb, Zr, Ta, Ca, Mg, rare earths and Y, if necessary,

S: not more than 0.003%.

This type of steel containing 3.0–5.0% Si, a higher proportion than in the steels of Example 2, for the purpose of further improving the oxidation resistance.

The heating temperature of the heat-resisting test was 1100° C., which was the highest. The test results are shown in Table 4.

One of the steels on the market corresponding to the steels above is JIS XM 15J1, the weight loss of which was 165.92 mg/cm$^2$ (Table 1). On the other hand, as is apparent from Table 4, the present invention steels the sulfur content of which was reduced to not more than 0.003% showed a weight loss of only one-half to one-fourth that of the steel on the market.

Particularly, remarkable improvement in oxidation resistance resulted from the combination of reduced sulfur content and the incorporation of Ca, Mg, rare earths or Y and/or the incorporation of Ti, Nb, Zr or Ta. It is to be noted that improvement in oxidation resistance due to the incorporation of these elements cannot be expected at all if the usual sulfur content is maintained.

TABLE 4

| steel | chemical composition (% by weight) C | Si | Mn | P | S | Ni | Cr | Cu | Al | Ti | Nb | Zr | Ta | Ca | Mg | R.E | Y | heating temp. (°C.) | test results change in weight (mg/cm²) |
|---|---|---|---|---|---|---|---|---|---|---|---|---|---|---|---|---|---|---|---|
| present invention 1 | 0.08 | 3.53 | 1.12 | 0.016 | 0.001 | 12.96 | 19.16 | | 0.002 | | | | | | | | | 1100 | −86.66 |
| present invention 2 | 0.034 | 3.43 | 1.24 | 0.015 | 0.001 | 12.90 | 19.10 | | 0.066 | | | | | | | | | " | −57.72 |
| present invention 3 | 0.021 | 3.48 | 0.64 | 0.025 | 0.002 | 12.97 | 18.75 | | 0.026 | | | | | 0.009 | | | | " | −60.85 |
| present invention 4 | 0.048 | 3.38 | 0.54 | 0.025 | 0.003 | 12.74 | 18.95 | | 0.013 | | | | | | 0.0010 | | | " | −64.94 |
| present invention 5 | 0.038 | 3.38 | 0.68 | 0.021 | 0.001 | 12.78 | 19.35 | | 0.009 | | | | | | | 0.0006 | | " | −53.72 |
| present invention 6 | 0.041 | 3.39 | 0.70 | 0.022 | 0.001 | 13.00 | 18.95 | | 0.007 | | | | | | 0.006 | | 0.0008 | " | −60.02 |
| present invention 7 | 0.050 | 3.43 | 0.71 | 0.023 | 0.001 | 12.70 | 19.15 | | 0.018 | | | | | 0.0073 | | | | " | −40.19 |
| present invention 8 | 0.041 | 3.49 | 0.52 | 0.022 | 0.002 | 12.68 | 19.10 | | 0.015 | | | | | 0.0010 | 0.0032 | 0.0015 | | " | −49.41 |
| reference 9 | 0.048 | 3.32 | 0.52 | 0.012 | 0.004 | 12.86 | 19.09 | | 0.018 | | | | | | | | | " | −162.80 |
| reference 10 | 0.045 | 3.28 | 1.01 | 0.011 | 0.005 | 13.07 | 18.78 | | 0.015 | | | | | 0.0051 | 0.0009 | | | " | −153.32 |
| reference 11 | 0.043 | 3.60 | 0.48 | 0.022 | 0.005 | 13.26 | 19.54 | | 0.002 | | | | | 0.0021 | | 0.0061 | | " | −164.28 |
| reference 12 | 0.039 | 3.30 | 0.50 | 0.021 | 0.005 | 13.90 | 19.07 | | 0.012 | | | | | 0.0010 | | | 0.010 | " | −175.83 |
| present invention 13 | 0.044 | 3.40 | 0.51 | 0.025 | 0.001 | 12.47 | 18.55 | 0.41 | 0.002 | | | | | | | | | " | −64.52 |
| present invention 14 | 0.034 | 3.52 | 0.53 | 0.005 | 0.001 | 12.56 | 18.88 | 0.70 | 0.054 | | | | | | | | | " | −58.90 |
| present invention 15 | 0.062 | 3.54 | 0.51 | 0.023 | 0.001 | 13.38 | 18.97 | 0.63 | 0.016 | | | | | 0.0013 | | | | " | −44.59 |
| present invention 16 | 0.08 | 3.60 | 0.49 | 0.028 | 0.002 | 14.47 | 19.35 | 0.48 | 0.048 | | | | | | 0.0026 | | | " | −49.20 |
| present invention 17 | 0.022 | 3.31 | 0.82 | 0.020 | 0.002 | 13.01 | 19.07 | 1.01 | 0.020 | | | | | 0.0021 | 0.0065 | | | " | −52.36 |
| present invention 18 | 0.033 | 4.76 | 0.53 | 0.005 | 0.001 | 12.45 | 19.45 | 1.50 | 0.008 | | | | | 0.009 | | 0.010 | | " | −60.08 |
| present invention 19 | 0.004 | 3.23 | 0.76 | 0.002 | 0.001 | 14.01 | 19.18 | 0.53 | 0.018 | | | | | 0.0005 | | | 0.0024 | " | −68.15 |
| present invention 20 | 0.016 | 3.76 | 0.92 | 0.018 | 0.002 | 13.05 | 19.03 | 0.33 | 0.029 | | | | | 0.0016 | 0.0012 | 0.0006 | | " | −41.83 |
| reference 21 | 0.041 | 3.36 | 0.58 | 0.023 | 0.006 | 12.99 | 19.03 | 0.47 | 0.009 | | | | | 0.0005 | | 0.0085 | | " | −166.03 |
| reference 22 | 0.056 | 3.52 | 0.51 | 0.027 | 0.005 | 13.30 | 19.14 | 0.62 | 0.005 | | | | | 0.0008 | | | 0.0023 | " | −148.52 |
| reference 23 | 0.045 | 3.62 | 0.64 | 0.020 | 0.012 | 13.15 | 18.86 | 1.74 | 0.018 | | | | | 0.032 | 0.038 | | | " | −178.89 |
| reference 24 | 0.062 | 3.28 | 0.54 | 0.015 | 0.009 | 13.51 | 18.90 | 0.40 | 0.034 | | | | | 0.008 | 0.022 | 0.0062 | | " | −168.94 |
| present invention 25 | 0.047 | 3.48 | 0.64 | 0.025 | 0.001 | 12.97 | 18.75 | | 0.002 | 0.26 | | | | | | | | " | −61.16 |
| present invention 26 | 0.048 | 3.42 | 0.52 | 0.020 | 0.003 | 13.08 | 19.01 | | 0.066 | | 0.41 | | | | | | | " | −58.37 |
| present invention 27 | 0.06 | 3.94 | 0.81 | 0.010 | 0.002 | 13.54 | 19.22 | | 0.028 | | | 0.40 | | 0.0038 | | | | " | −46.03 |
| present invention 28 | 0.030 | 3.71 | 0.64 | 0.003 | 0.001 | 13.08 | 18.92 | | 0.015 | | | | 0.55 | | 0.0029 | | | " | −60.92 |
| reference 29 | 0.045 | 3.43 | 0.54 | 0.025 | 0.008 | 13.00 | 18.88 | | 0.027 | 0.39 | | | | 0.0009 | | 0.0023 | | " | −169.51 |
| reference 30 | 0.049 | 3.12 | 0.54 | 0.035 | 0.012 | 13.01 | 18.73 | | 0.007 | | | | | 0.0011 | | | 0.0034 | " | −155.83 |

EXAMPLE 4

In this example, the resistance to high temperature oxidation of steels having the following composition was determined:

C: not more than 0.10%, Si: 0.1–3.0%,
Mn: not more than 3%, Ni: 10–15%,
Cr: 20–25%, at least one of Al, Cu, Mo,
Tr, Nb, Zr, Ta, Ca, Mg, rare earths and Y, if necessary,
S: not more than 0.003%.

This type of steel has a higher chromium content of 20–25%, corresponding to SUS 309S steel.

Table 5 shows the test results, the heating temperature being 1050° C.

In this example, too, it is noted that the weight loss of the present invention steels was only ½ to ⅓ that of the commercially available SUS 309S steel (see Table 1) under the same conditions.

TABLE 5

| steel | chemical composition (% by weight) | | | | | | | |
|---|---|---|---|---|---|---|---|---|
| | C | Si | Mn | P | S | Ni | Cr | Al |
| present invention 1 | 0.05 | 0.56 | 0.87 | 0.022 | 0.001 | 12.56 | 22.82 | 0.002 |
| present invention 2 | 0.07 | 0.66 | 0.91 | 0.018 | 0.001 | 13.02 | 23.09 | 0.046 |
| present invention 3 | 0.035 | 0.32 | 1.24 | 0.028 | 0.002 | 14.21 | 23.51 | 0.015 |
| present invention 4 | 0.010 | 0.47 | 0.66 | 0.015 | 0.002 | 13.84 | 22.54 | 0.005 |
| present invention 5 | 0.06 | 0.51 | 0.94 | 0.025 | 0.001 | 12.40 | 22.31 | 0.009 |
| present invention 6 | 0.040 | 0.82 | 0.81 | 0.012 | 0.002 | 12.86 | 23.36 | 0.017 |
| present invention 7 | 0.024 | 0.44 | 0.67 | 0.023 | 0.001 | 14.72 | 23.88 | 0.042 |
| present invention 8 | 0.07 | 0.72 | 0.92 | 0.019 | 0.002 | 14.01 | 23.05 | 0.024 |
| present invention 9 | 0.05 | 0.81 | 0.98 | 0.016 | 0.002 | 12.75 | 22.86 | 0.034 |
| reference 10 | 0.042 | 0.53 | 0.88 | 0.026 | 0.005 | 12.73 | 22.60 | 0.018 |
| reference 11 | 0.06 | 0.73 | 0.98 | 0.020 | 0.006 | 13.31 | 23.05 | 0.012 |
| reference 12 | 0.05 | 0.48 | 1.06 | 0.021 | 0.006 | 12.48 | 22.25 | 0.008 |
| reference 13 | 0.022 | 0.51 | 0.89 | 0.015 | 0.005 | 12.50 | 22.31 | 0.064 |
| reference 14 | 0.05 | 0.83 | 0.90 | 0.017 | 0.007 | 12.71 | 22.65 | 0.036 |

EXAMPLE 5

In this example, the resistance to high temperature oxidation of steels having the following composition was determined.

C: not more than 0.10%, Si: 0.1–1.0%,
Mn: not more than 3%, Ni: 30–35%,
Cr: 20–25%, at least one of Al, Cu, Mo,
Ti, Nb, Zr, Ta, Ca, Mg, rare earths and Y, if necessary,
S: not more than 0.003%.

This type of steel has a higher chromium content of 20–25% and an increased amount of nickel and is used in applications where both oxidation resistance and high temperature strengh are required.

The commercially available steel corresponding thereto is Incoloy 800 (trade name).

In view of the results of the oxidation resistance test with the heating temperature of 1000° C. (see Table 6), it is noted that the improvement in oxidation resistance of the present invention steels is significant compared with that of the above Incoloy 800 (see Table 1), and that the improvement in oxidation resistance is remarkably significant if Ca, Mg etc. and Ti, Zr etc. are incorporated.

However, the reference steels which contain these additives together with a sulfur content over 0.003% do not show any significant improvement in oxidation resistance over Incoloy 800.

TABLE 6

| steel | chemical composition (% by weight) C | Si | Mn | P | S | Ni | Cr | Cu | Mo | Al | Ti | No | Zr | Ta | Ca | Mg | R.E | Y | heating temp. (°C.) | test results change weight ($mg/cm^2$) |
|---|---|---|---|---|---|---|---|---|---|---|---|---|---|---|---|---|---|---|---|---|
| present invention 1 | 0.05 | 0.56 | 1.12 | 0.015 | 0.001 | 32.05 | 21.68 | | | 0.005 | | | | | | | | | 1000 | −30.06 |
| present invention 2 | 0.08 | 0.72 | 1.01 | 0.018 | 0.002 | 34.52 | 20.54 | | | 0.074 | | | | | | | | | " | −25.05 |
| present invention 3 | 0.034 | 0.42 | 0.95 | 0.023 | 0.001 | 33.42 | 22.26 | | | 0.022 | | | | | 0.0012 | | | | " | −28.91 |
| present invention 4 | 0.014 | 0.26 | 0.89 | 0.012 | 0.001 | 32.54 | 22.38 | | | 0.015 | | | | | | 0.0020 | | | " | −32.15 |
| present invention 5 | 0.047 | 0.62 | 0.66 | 0.009 | 0.002 | 33.81 | 22.84 | | | 0.006 | | | | | 0.0005 | | 0.0010 | | " | −30.01 |
| present invention 6 | 0.06 | 0.77 | 1.37 | 0.005 | 0.002 | 30.06 | 20.28 | | | 0.009 | | | | | 0.006 | | | 0.0014 | " | −30.54 |
| present invention 7 | 0.09 | 0.94 | 1.22 | 0.029 | 0.002 | 32.43 | 22.66 | | | 0.032 | | | | | 0.0051 | | | | " | −21.82 |
| present invention 8 | 0.005 | 0.47 | 0.91 | 0.020 | 0.001 | 31.09 | 20.82 | | | 0.008 | | | | | 0.0028 | 0.0015 | | | " | −16.67 |
| reference 9 | 0.040 | 0.49 | 1.10 | 0.016 | 0.005 | 32.35 | 21.24 | | | 0.002 | | | | | | | | | " | −86.62 |
| reference 10 | 0.05 | 0.51 | 1.32 | 0.020 | 0.005 | 33.01 | 22.06 | | | 0.022 | | | | | 0.0036 | 0.0030 | | | " | −90.53 |
| reference 11 | 0.08 | 0.62 | 1.05 | 0.023 | 0.006 | 32.55 | 20.40 | | | 0.015 | | | | | 0.0045 | | 0.0092 | | " | −80.43 |
| reference 12 | 0.016 | 0.58 | 0.99 | 0.010 | 0.005 | 32.32 | 20.85 | | | 0.009 | | | | | 0.0062 | | | 0.0081 | " | −81.15 |
| present invention 13 | 0.07 | 0.53 | 1.32 | 0.016 | 0.002 | 32.84 | 20.03 | 0.45 | | 0.009 | | | | | 0.0012 | | | 0.0009 | " | −9.82 |
| present invention 14 | 0.012 | 0.49 | 1.38 | 0.021 | 0.001 | 33.05 | 20.08 | | 2.06 | 0.0023 | | | | | 0.0034 | | | | " | −10.16 |
| present invention 15 | 0.035 | 0.56 | 1.12 | 0.009 | 0.003 | 33.32 | 21.54 | 0.48 | 2.25 | 0.0013 | | | | | 0.0025 | 0.0024 | 0.0009 | | " | −8.50 |
| reference 16 | 0.05 | 0.58 | 1.62 | 0.015 | 0.009 | 33.15 | 20.96 | 0.42 | | 0.002 | | | | | 0.004 | 0.009 | | | " | −74.42 |
| reference 17 | 0.13 | 0.53 | 1.41 | 0.023 | 0.007 | 34.01 | 20.15 | | 2.24 | 0.0026 | | | | | 0.0046 | | | | " | −78.59 |
| present invention 18 | 0.06 | 0.51 | 1.24 | 0.018 | 0.002 | 30.56 | 20.24 | | | 0.009 | 0.38 | | | | 0.0004 | | 0.0006 | | " | −11.82 |
| present invention 19 | 0.035 | 0.56 | 1.32 | 0.020 | 0.001 | 33.46 | 22.05 | | | 0.006 | 0.18 | 0.16 | | | 0.0008 | | | 0.0008 | " | −11.53 |
| present invention 20 | 0.001 | 0.56 | 1.15 | 0.002 | 0.002 | 31.81 | 21.50 | | | 0.0021 | | | 0.12 | | 0.0022 | 0.036 | | | " | −9.97 |
| present invention 21 | 0.012 | 0.46 | 1.40 | 0.020 | 0.001 | 32.25 | 20.70 | | | 0.030 | | | 0.08 | 0.10 | 0.0031 | 0.0015 | | | " | −10.50 |
| reference 22 | 0.05 | 0.48 | 1.24 | 0.016 | 0.011 | 32.14 | 20.95 | | | 0.043 | | 0.59 | | | 0.0031 | 0.0031 | | | " | −70.02 |

EXAMPLE 6

In this example, the resistance to high temperature oxidation of steels having the following composition was determined:

C: not more than 0.10%, Si: 0.1–3.0%,
Mn: not more than 3%, Ni: 15–25%,
Cr: 20–30%, at least one of Al, Cu, Mo,
Ti, Nb, Zr, Ta, Ca, Mg, rare earths and Y, if necessary,
S: not more than 0.003%.

This type of steel containing a larger amount of chromium of 20–30% can show the most improved resistance to oxidation and is intended to be used in an especially severe high temperature oxidizing atmosphere.

The commercially available steel corresponding thereto is SUS 310S, which shows a weight loss of about 80 mg/cm$^2$ in the severe oxidizing test including 400 cycles of holding at 1100° C. and cooling as indicated in Table 1.

On the contrary, the weight loss of the present invention steel shown in Table 7 is around 30 mg/cm$^2$, which is markedly small.

TABLE 7

| steel | chemical composition (% by weight) C | Si | Mn | P | S | Ni | Cr | Al | heating temp. (°C.) | test results change in weight (mg/cm$^2$) |
|---|---|---|---|---|---|---|---|---|---|---|
| present invention 1 | 0.06 | 0.98 | 0.81 | 0.025 | 0.001 | 20.54 | 25.01 | 0.002 | 1100 | −33.05 |
| present invention 2 | 0.046 | 1.15 | 0.94 | 0.020 | 0.001 | 21.43 | 24.89 | 0.042 | " | −30.54 |
| present invention 3 | 0.05 | 1.06 | 0.79 | 0.012 | 0.002 | 20.03 | 24.46 | 0.018 | " | −30.91 |
| present invention 4 | 0.07 | 0.79 | 0.72 | 0.004 | 0.002 | 19.54 | 24.92 | 0.007 | " | −33.82 |
| present invention 5 | 0.023 | 0.68 | 0.85 | 0.015 | 0.001 | 19.88 | 25.32 | 0.027 | " | −32.06 |
| present invention 6 | 0.002 | 0.51 | 0.60 | 0.022 | 0.002 | 19.86 | 24.97 | 0.011 | " | −31.54 |
| present invention 7 | 0.047 | 0.72 | 0.81 | 0.016 | 0.002 | 21.01 | 25.87 | 0.032 | " | −29.52 |
| present invention 8 | 0.07 | 1.35 | 1.32 | 0.020 | 0.001 | 20.86 | 24.22 | 0.026 | " | −29.88 |
| reference 9 | 0.06 | 1.27 | 1.15 | 0.022 | 0.007 | 20.38 | 25.23 | 0.030 | " | −78.11 |
| present invention 10 | 0.09 | 0.88 | 1.01 | 0.025 | 0.001 | 20.41 | 24.92 | 0.002 | " | −29.58 |
| present invention 11 | 0.046 | 1.03 | 0.86 | 0.015 | 0.001 | 19.56 | 25.37 | 0.046 | " | −22.71 |
| present invention 12 | 0.027 | 0.75 | 0.95 | 0.021 | 0.003 | 20.03 | 25.06 | 0.016 | " | −20.31 |
| present invention 13 | 0.06 | 0.95 | 0.92 | 0.018 | 0.001 | 20.72 | 24.69 | 0.024 | " | −30.00 |
| reference 14 | 0.06 | 1.15 | 0.89 | 0.019 | 0.009 | 20.38 | 24.75 | 0.013 | " | −80.73 |

| steel | chemical composition (% by weight) Ti | Nb | Zr | Ta | Ca | Mg | R.E | Y | heating temp. (°C.) | test results change in weight (mg/cm$^2$) |
|---|---|---|---|---|---|---|---|---|---|---|
| present invention 1 | | | | | | | | | 1100 | −33.05 |
| present invention 2 | | | | | | | | | " | −30.54 |
| present invention 3 | | | | | 0.0012 | | | | " | −30.91 |
| present invention 4 | | | | | | 0.0029 | | | " | −33.82 |
| present invention 5 | | | | | | | 0.008 | | " | −32.06 |
| present invention 6 | | | | | 0.008 | | | 0.0008 | " | −31.54 |
| present invention 7 | | | | | 0.0039 | | | | " | −29.52 |
| present invention 8 | | | | | 0.0011 | 0.0030 | | | " | −29.88 |
| reference 9 | | | | | 0.0048 | | | | " | −78.11 |
| present invention 10 | 0.45 | | | | | | | | " | −29.58 |
| present invention 11 | | 0.43 | | | | | | | " | −22.71 |
| present invention 12 | | | 0.25 | | 0.0018 | | | | " | −20.31 |
| present invention 13 | | 0.35 | | 0.62 | | 0.0033 | | | " | −30.00 |
| reference 14 | 0.40 | | | | 0.0023 | 0.0046 | | | " | −80.73 |

EXPLOITABILITY IN INDUSTRY OF THE INVENTION

As is apparent from the embodiments of the present invention shown hereinbefore, the improvement in oxidation resistance of the austenitic steel of the present invention is significant and the weight loss due to oxidation is reduced to approximately less than half that of a commercially available steel corresponding thereto. Thhis means that the service life of the present invention steel may be prolonged by twice or more that of a commercially available steel corresponding thereto under the same conditions, and that a less expensive and lower grade steel containing a smaller amount of Ni, Cr etc. than the conventional steel may be used with the same length of service life.

The embodiments of the present invention disclosed hereinbefore correspond to typical steels on the market and are of high value in practical use. But, it is to be noted that all the present invention steels encompassed by the scope of the appended claims, though they are not specifically disclosed in the examples, have improved resistance to oxidation.

It is apparent that the present invention steel can never show any degradation in its properties other than the oxidation resistance, such as mechanical strength, toughness, workability, weldability etc. in comparison with those of the conventional steels, and can show improvement in some of them due to the lower sulfur content.

What we claim is:

1. An austenitic steel, said austenitic steel having improved resistance to oxidation at temperatures above 700° C. and consisting essentially of the following alloying elements:

C: not greater than 0.10%
Si: more than 1%, but not greater than 5.0%
Mn: not greater than 3.0%
Ni: 7–15%
Cr: 15–20%,
the amounts of said alloying elements being adjusted to result in an austenitic microstructure, and
a balance of iron and impurities of which sulfur is restricted to not greater than 0.003%.

2. An austenitic steel, said austenitic steel having improved resistance to oxidation at temperatures above 700° C. and consisting essentially of the following alloying elements:
C: not greater than 0.10%
Si: more than 1%, but not greater than 5.0%
Mn: not greater than 3.0%
Ni: 10–15%
Cr: 15–25%,
the amounts of said alloying elements being adjusted to result in an austenitic microstructure, and
a balance of iron and impurities of which sulfur is restricted to not greater than 0.003%.

3. An austenitic steel, said austenitic steel having improved resistance to oxidation at temperatures above 700° C. and consisting essentially of the following alloying elements:
C: not greater than 0.10%
Si: more than 1%, but not greater than 5.0%
Mn: not greater than 3.0%
Ni: 15–25%
Cr: 20–30%,
the amounts of said alloying elements being adjusted to result in an austenitic microstructure, and
a balance of iron and impurities of which sulfur is restricted to not greater than 0.003%.

4. An austenitic steel, said austenitic steel having improved resistance to oxidation at temperatures above 700° C. and consisting essentially of the following alloying elements:
C: not greater than 0.10%
Si: 0.1–1.0%
Mn: not greater than 3.0%
Ni: 30–35%
Cr: 20–25%,
the amounts of said alloying elements being adjusted to result in an austenitic microstructure, and
a balance of iron and impurities of which sulfur is restricted to not greater than 0.003%.

5. An austenitic steel as defined in any one of claims 1 and 2–4, which further comprises not greater than 0.1% Al.

6. An austenitic steel as defined in any one of claims 1 and 2–4, which further comprises one or more of Ca, Mg, Y and rare earths, the total amount thereof being not greater than 0.10%.

7. An austenitic steel as defined in any one of claims 1 and 2–4, which further comprises one or more of Ti, Nb, Zr, and Ta, the total amount thereof being 4XC% to 1.5%.

8. An austenitic steel as defined in any one of claims 1 and 2–4, which further comprises not greater than 1.5% Cu and/or not greater than 3% Mo.

9. An austenitic steel as defined in claim 1 or 2, in which Si is 3–5%, Ni is 10–15% and Cr is 15–20%.

10. An austenitic steel having improved resistance to oxidation at high temperature as defined in any one of claims 1 and 2–4, wherein sulfur is restricted to not greater than 0.0015%.

11. An austenitic steel as defined in claim 6, which further comprises one or more of Ti, Nb, Zr and Ta the total amount thereof being 4XC% to 1.5%.

12. An austenitic steel as defined in claim 6, which further comprises not greater than 1.5% Cu and/or not greater than 3% Mo.

13. An austenitic steel as defined in claim 7, which further comprises not greater than 1.5% Cu and/or not greater than 3% Mo.

14. An austenitic steel as defined in claim 6, in which Si is 3–5%, Ni is 10–15% and Cr is 15–20%.

15. An austenitic steel as defined in claim 7, in which Si is 3–5%, Ni is 10–15% and Cr is 15–20%.

16. An austenitic steel as defined in claim 8, in which Si is 3–5%, Ni is 10–15% and Cr is 15–20%.

17. An austenitic steel, said austenitic steel having improved resistance to oxidation at temperatures above 700° C. and consisting essentially of the following alloying elements:
C: not greater than 0.10%
Si: 0.1–1.0%
Mn: not greater than 3%
Ni: 7–25%
Cr: 15–30%
the amount of said alloying elements being adjusted to result in an austenitic single phase microstructure; and
a balance of iron and impurities of which sulfur is restricted to not greater than 0.003%.

18. An austenitic steel as defined in claim 17, which further comprises one or more of Ti, Nb, Zr and Ta the total amount thereof being 4XC% to 1.5%.

19. An austenitic steel as defined in claim 17, which further comprises not greater than 1.5% Cu and/or not greater than 3% Mo.

20. An austenitic steel as defined in claim 17, which further comprises not greater than 1.5% Cu and/or not greater than 3% Mo.

21. An austenitic steel having improved resistance to oxidation at high temperatures as defined in claim 17 wherein sulfur is restricted to not greater than 0.0015%.

22. An austenitic steel as defined in claim 17, which further comprises less than 0.10% of Al as a deoxidizing agent, and one or more of Ca, Mg, Y and rare earths, the total amount thereof being not greater than 0.10%.

23. An austenitic steel, said austenitic steel having improved resistance to oxidation at temperatures above 700° C. and consisting essentially of the following alloying elements:
C: not greater than 0.10%
Si: more than 1%, but not greater than 5.0%
Mn: not greater than 3%
Ni: 7–25%
Cr: 15–30%
Al: less than 0.10% as a deoxidizing agent, one or more of Ca, Mg, Y and rare earths, the total amount thereof being not greater than 0.10%,
the amount of said alloying elements being adjusted to result in an austenitic microstructure; and
a balance of iron and impurities of which sulfur is restricted to not greater than 0.003%.

24. An austenitic steel as defined in claim 23 in which Si is present in amount of 3–5%.

* * * * *